United States Patent [19]

Allvin

[11] 4,219,724

[45] Aug. 26, 1980

[54] THERMOSTATICALLY CONTROLLED ELECTRICALLY HEATED HAND TOOL FOR PRESSING GARMENTS

[76] Inventor: Bertil Allvin, Asgatan 9, 710 60 Grythyttan, Sweden

[21] Appl. No.: 822,900

[22] Filed: Aug. 8, 1977

Related U.S. Application Data

[63] Continuation-in-part of Ser. No. 760,826, Jan. 21, 1977, abandoned, which is a continuation of Ser. No. 628,993, Nov. 5, 1975, abandoned.

[30] Foreign Application Priority Data

Nov. 13, 1974 [SE] Sweden ..... 7414224

[51] Int. Cl.[2] ..... D06F 75/30; H05B 3/02

[52] U.S. Cl. ..... 219/243; 38/71; 38/82; 38/90; 38/93; 156/579; 219/230; 219/241; 219/252; 219/524; 223/36

[58] Field of Search ..... 219/221, 227, 225, 230, 219/241, 243, 245, 237, 248, 252–255, 524; 156/579; 38/69, 71, 72, 82, 90, 93, 94; 223/35, 36

[56] References Cited

U.S. PATENT DOCUMENTS

| | | | |
|---|---|---|---|
| 999,581 | 8/1911 | Mills | 38/71 |
| 999,601 | 8/1911 | Schweinler | 38/71 |
| 1,139,069 | 5/1915 | Pfanstiehl | 219/243 |
| 2,198,924 | 4/1940 | Smith | 219/248 X |
| 2,258,844 | 10/1941 | Brown et al. | 219/243 X |
| 2,299,462 | 10/1942 | Clark et al. | 219/248 X |
| 2,317,406 | 4/1943 | Ryan | 38/71 |
| 2,441,817 | 5/1948 | Huff | 219/230 X |
| 2,484,899 | 10/1949 | Mayo | 38/69 X |
| 2,528,019 | 10/1950 | Storm | 219/254 X |
| 2,535,171 | 12/1950 | Sundstrom | 219/243 X |
| 2,648,757 | 8/1953 | Harper | 219/241 X |
| 2,748,511 | 6/1956 | Pezza | 38/71 |
| 3,092,707 | 6/1963 | Wirth | 38/90 X |
| 3,121,781 | 2/1964 | Schoenwald | 219/237 |

FOREIGN PATENT DOCUMENTS

| | | | |
|---|---|---|---|
| 417539 | 1/1947 | Italy | 219/243 |
| 555069 | 6/1957 | Italy | 219/243 |
| 121765 | 5/1948 | Sweden | 219/243 |
| 1358562 | 7/1974 | United Kingdom | 219/225 |

*Primary Examiner*—A. Bartis

*Attorney, Agent, or Firm*—Hane, Roberts, Spiecens & Cohen

[57] ABSTRACT

A manually operable device for pressing fabric comprising two triangular-shaped jaws, each of which has a flat surface portion. These surface portions face each other and constitute the working surfaces of the device. The two jaws are each secured to a handle. These handles are pivotally joined by a hinge so disposed that the two flat surface portions are separated from each other or are in parallel pressure engagement. The separated position of the surface portions constitutes the loading position of the device for inserting fabric between the two jaws and the other position constitutes the pressing position for pressing fabric inserted between the two jaws. Springs coacting with the handles bias the same into one or the other of the two positions. One of the jaws is hollow and incorporates an electric heating element for heating its flat surface portion, an adjustable thermostatic control for selectively adjusting the heat output of the heating element and an indicator lamp for indicating the state of energization of the heating element. The other jaw comprises a solid flat metallic plate.

6 Claims, 5 Drawing Figures

THERMOSTATICALLY CONTROLLED ELECTRICALLY HEATED HAND TOOL FOR PRESSING GARMENTS

CROSS REFERENCES TO RELATED APPLICATIONS

This application is a continuation-in-part of application Ser. No. 760,826 filed Jan. 21, 1977, now abandoned which is a continuation of application Ser. No. 628,933 filed Nov. 5, 1975, now abandoned.

BACKGROUND OF THE INVENTION

The present invention relates to a heated hand cloth presser.

Such pressers are needed by people who are traveling and who must stay at hotels where it is not always possible to obtain quick service for the pressing and freshening of articles of clothing that have become wrinkled after having been kept in baggage. There have hitherto been available small traveler's flatirons that can be used in hotel rooms. However, as a rule there are great problems involved in their use, as it is then necessary to utilize one of the tables in the hotel room to do the ironing. Thus, there is then a great risk that the table might be damaged by the heat from the small flatiron.

SUMMARY OF THE INVENTION

It is accordingly a general object of the invention to provide an improved cloth pressing device which does not necessarily require a flat surface to act as the pressing board.

Briefly, the invention contemplates a manually operable heated device for pressing fabric, having a pair of jaws, with flat surface portions constituting the pressing surfaces. One of the jaws is hollow for holding heating element wires, a thermostat and an indicator lamp, and the other is a solid plate.

An elongate handle is secured at one end to each of the jaws with hinge means pivotally joining the handles so that the flat surface portions face each other for selectively pivoting the jaws into the positions in which the flat surface portions of the jaws are in parallel pressure engagement which is the working position of the device or into positions in which the flat surface portions are separated from each other, which is the loading position for inserting fabric to be pressed. Spring means coact with the handles for biasing the flat surface portions into either one of said two positions. An electric connecting wire extends lengthwise through the handle mounting the hollow jaw to the heating element wires.

BRIEF DESCRIPTION OF THE DRAWING

Other objects, features and advantages of the invention will be apparent from the following detailed description when read with the accompanying drawing which shows by way of example and not limitation the presently preferred embodiment of the invention.

In the drawing.

DESCRIPTION OF THE PREFERRED EMBODIMENT

Figure 1:
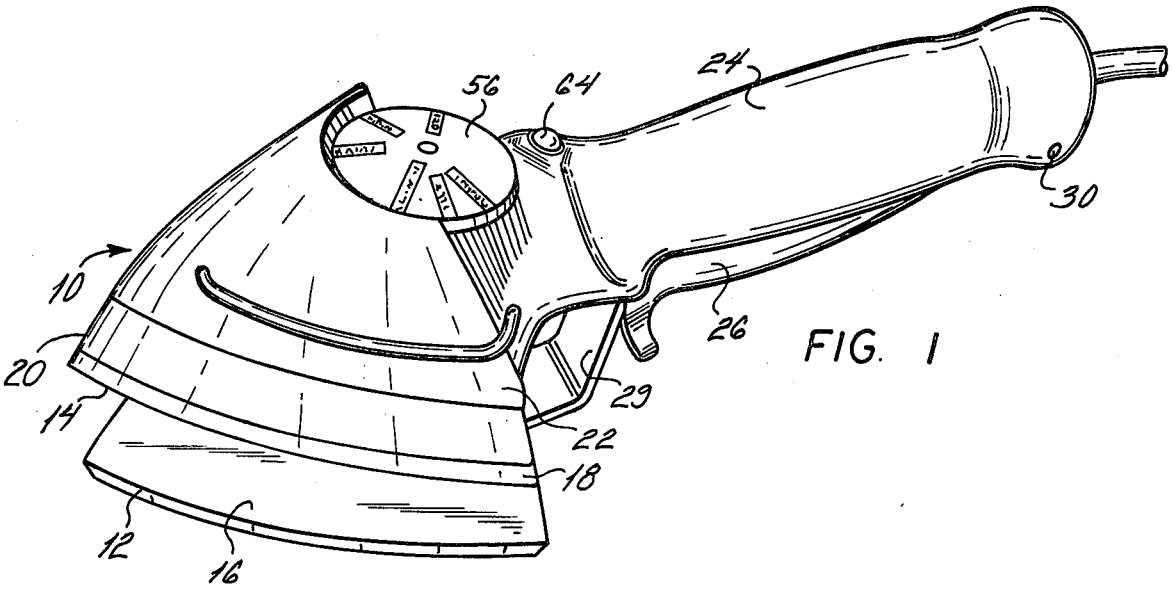
FIG. 1 is a top perspective view of the pressing device according to the invention.
Figure 2:
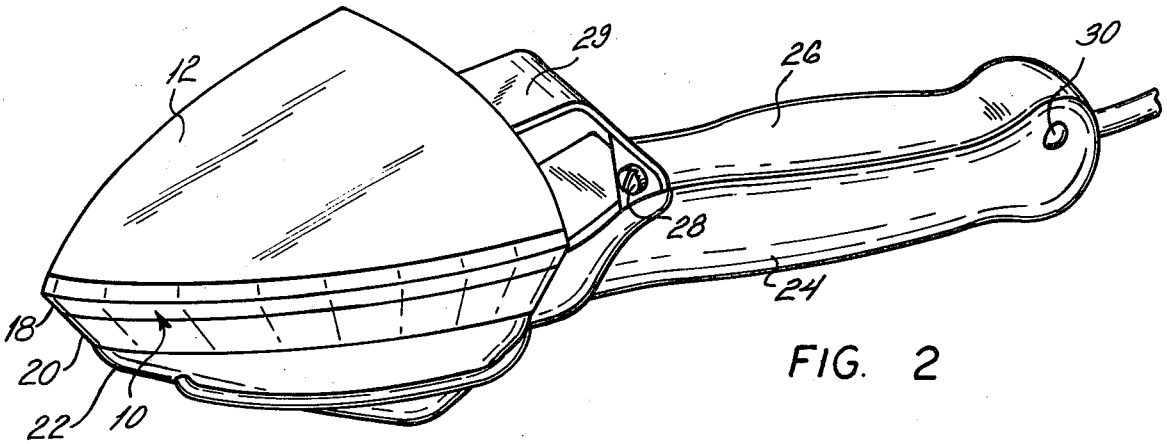
FIG. 2 is a bottom perspective view of the pressing device of FIG. 1.
Figure 3:
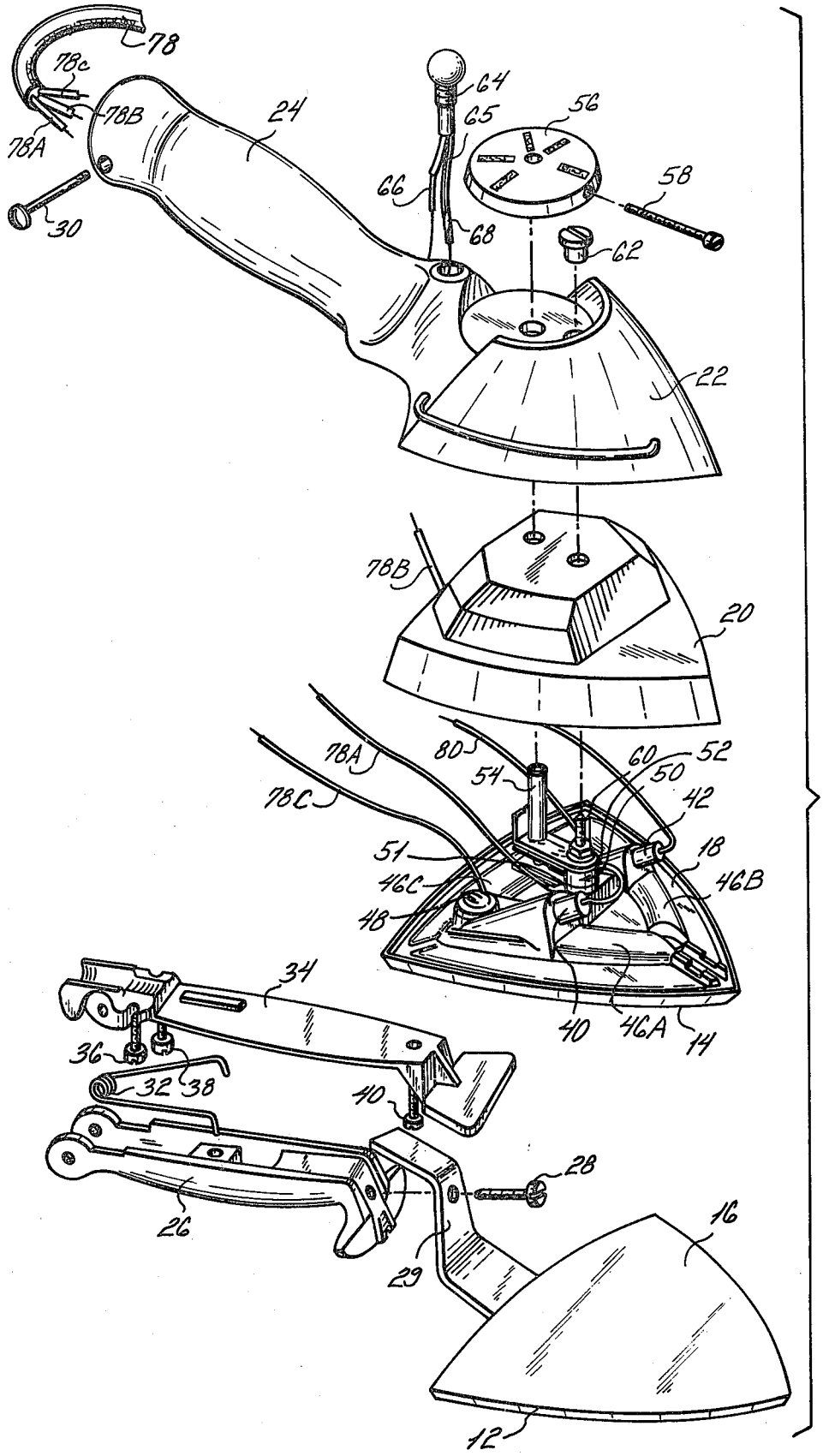
FIG. 3 is an exploded view of the pressing device of FIG. 1.

In FIGS. 1, 2 and 3 the pressing device is shown having two triangular shaped jaws 10 and 12 with flat pressing surfaces 14 and 16, respectively. The jaw 12 is a flat solid plate as best seen in FIG. 3. The jaw 10 is hollow and comprises a heatable sole plate 18, whose bottom surface is pressing surface 14, an intermediate cover member 20, and a housing member 22. A handle 24 has an end integral with housing member 22 of jaw 10; and a handle 26 has one end fixed by means of screw 28 to a tab 29 of jaw 12. The other ends of the handles are hinged together by means of screw 30. A spring 32 has ends which abut against the handles 24 and 26 to bias the jaws in the open position. Handle 24, being hollow, is provided with a cover plate 34 which is fixed to the handle by screws 36, 38 and 40.

The sole plate 18 is provided with a pair of terminals 40 and 42 for supplying the heating current to insulated resistance wires such as wire 44(FIG. 4) within the three triangular chambers 46A, 46B and 46C on sole plate 18. Fixed to sole plate 18 is a grounding terminal 48. Mounted on sole plate 18 is a conventional adjustable bimetal thermostate 50 with terminals 51 and 52. A temperature adjustment shaft 54 for thermostat 50 is fixed to fabric selection dial 56 by set-screw 58. Sole plate 18, intermediate cover member 20, and housing member 22 are held together by means of screw 60 and nut 62. An on-indicator lamp 64 with an inline resistor 65 is mounted in handle 24 and has connection terminals 66 and 68.

Figure 4:
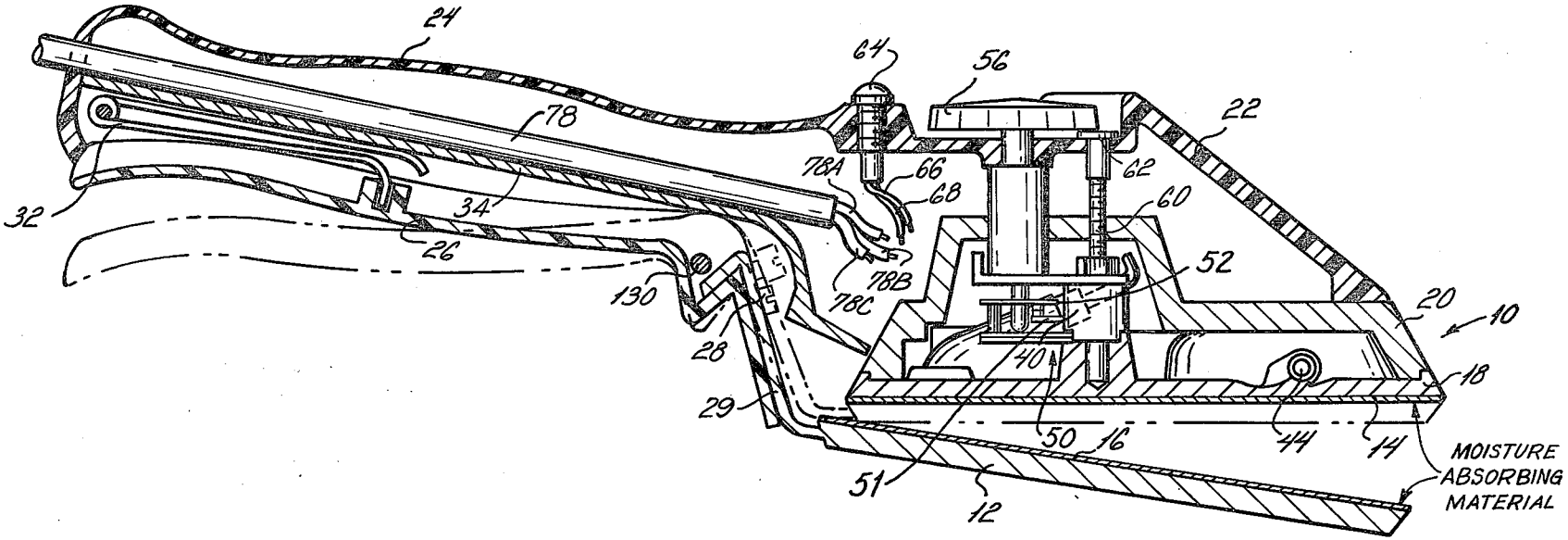
FIG. 4 is a longitudinal sectional view of another embodiment of the pressing device of FIG. 1.

In some cases, it may be desirable to cover the surface portion 14 and 16 with a temperature resistant moisture absorbent material as shown in FIG. 4.

Figure 5:
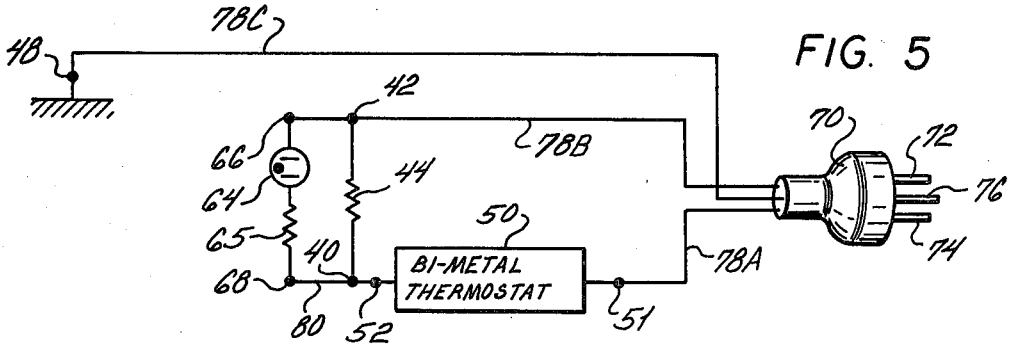
FIG. 5 is a schematic diagram of the electrical circuitry of the pressing device.

The electrical circuit is best described by making reference to FIGS. 3 and 5. A conventional three-prong plug having two power prongs 72 and 74 and a grounding prong 76 is connected to the three-wire cable 78 with wires 78A, 78B and 78C. The wire 78C is the ground wire and connected to terminal 48. The power wire 78A is connected to the terminal 51 at the input side of the bimetal thermostat 50. The power wire 78B is connected via terminal 42 to the resistance wire 44 of the sole plate 18. The wire 80 connects output terminal 52 of the thermostat 50 to terminal 68 of the indicator lamp comprising neon bulb 64 and limiting resistor 65 whose other terminal 66 is connected to the terminal 42 of the resistance wire 44 of the sole plate 18. The other end resistance wire is connected to wire 80 via terminal 40.

Thus, in operation when the plug 70 is inserted in a conventional outlet, sole plate 18 is grounded by virtue of line 78C being connected to terminal 48 of the sole plate 18. In addition, power is connected across a circuit which includes thermostat 50 and the insulated resistance wire 44 in the sole plate 18 between terminals 40 and 42. When the thermostat contacts are closed, current flows through wire 44 heating the sole plate 18 and lighting the indicator lamp 64. When the desired temperature is reached, the thermostat 50 opens, terminating current flow to resistance wire 44 and extinguishing the indicator lamp. When the sole plate temperature drops below a certain point, the thermostat contacts again close and the cycle repeats.

The pressing device operates in the following way:

If the object to be pressed is a pair of trousers, the trousers are hung up vertically with the aid of a conventional trousers hanger. With the pressing device in the position shown in FIG. 1 and set for the desired temperature with the aid fo dial 56, a trouser leg is approached and is set between the two jaws. The covering in the surfaces 14 and 16 may or may have been moistened as desired.

The two handles 24 and 26 are then squeezed together to the position shown in FIG. 2. When it has been assumed that the inserted part of the trousers has been pressed, the device is moved to an adjacent part of the trousers, to continue the pressing.

FIG. 4 is another embodiment of the invention which is identical to the device of FIGS. 1, 2 and 3 except that the jaws are normally biased to the closed position because pivoting occurs around screw 130 at the forward end of the handles instead of screw 30 at the rear end of the handles as shown in FIGS. 1, 2 and 3. Accordingly, the same reference characters are used for identical elements. Note also the dot-dash lines show the closed position of the device.

While the invention has been described in detail with respect to a certain now preferred example and embodiment of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A manually operable device for pressing fabric, said device comprising:

a pair of jaws, each of said jaws having a flat surface portion, said surface portions constituting the pressing surfaces of the device, one of said jaws being hollow and the other being a flat solid plate;

an elongate handle for each of said jaws, each of said handles being secured at one end to a respective one of the jaws;

hinge means pivotally joining said handles so that said flat surface portions face each other for selectively pivoting the jaws into the positions in which the flat surface portions of the jaws are in parallel pressure engagement, said positions constituting the working position of the device or into positions in which said flat surface portions are separated from each other, said latter position being the loading position for inserting fabric to be pressed between said flat surface portions;

spring means coacting with said handles for biasing the flat surface portions into one of said two positions;

electric heating means included in the hollow one of said jaws for heating the flat surface portion thereof;

an electric connecting cable extending lengthwise through the handle secured to the hollow jaw including the heating means;

adjustable thermostatic control means mounted on the hollow jaw and coacting with said heating means for selectively adjusting the heat output thereof; and indicating means for indicating when said heating means in energized, said electrical heating means comprising a tunnel structure in the hollow jaw and a resistance wire in the tunnel structure, said electric connecting cable comprising a three wire cable, one end of the first and second wires being adapted to be connected to an electric outlet and one end of the third wire being adapted to be grounded, the second ends of said first and second wires being connected to the end of said resistance wire and the other end of said third wire being connected to the hollow jaw, said adjustable thermostatic control means comprising a thermostat connected electrically in series with said first wire and in thermal contact with the hollow jaw, said indicating means comprising the combination of a neon bulb in series with a resistor, said combination being in parallel with said resistance wire, said jaws being of triangular shape, said handle for each jaw extending therefrom at the base of the respective jaw of triangular shape, said hollow jaw having an upper surface remote from the solid jaw, said adjustable thermostatic control means further comprising a control dial disposed at said upper surface, said neon bulb being mounted adjacent said dial and visible from above said hollow jaw, said hollow jaw comprising a sole plate having a flat pressing surface and provided with said tunnel structure, an intermediate cover member on said sole plate and covering said thermostat, a housing member on said intermediate cover member and integral with said handle for the hollow jaw, and attachment means securing said housing member, said cover member and said sole plate together as a unitary assembly to form said hollow jaw, said upper surface of the hollow jaw being constituted by the upper surface of the housing member.

2. The device according to claim 1 wherein said spring means are positioned to bias said flat surface portions into the loading position, squeezing the handles towards each other, forcing said surface portions into the pressing position.

3. The device according to claim 1 wherein said spring means are positioned to bias said flat surface portions into the pressing position, squeezing of the handles pivoting the flat surface portions into the loading position.

4. The device according to claim 1 wherein said hinge means are disposed at the other end of the handles and said spring means are disposed intermediate the handle ends.

5. The device according to claim 1 wherein said hinge means and said spring means are disposed intermediate the ends of said handles, said spring means being disposed to bias said flat surface portions into the pressing position.

6. The device according to claim 1 wherein comprising a moisture absorbing material is attached to each of said flat surface portions.

* * * * *